US011056762B2

(12) United States Patent
Lin et al.

(10) Patent No.: US 11,056,762 B2
(45) Date of Patent: Jul. 6, 2021

(54) ADJUSTABLE ANTENNA MOUNT

(71) Applicant: JONSA TECHNOLOGIES CO., LTD., Nantou (TW)

(72) Inventors: Ming-Tien Lin, Nantou (TW); Tien-Chih Pan, Nantou (TW)

(73) Assignee: JONSA TECHNOLOGIES CO., LTD., Nantou (TW)

( * ) Notice: Subject to any disclaimer, the term of this patent is extended or adjusted under 35 U.S.C. 154(b) by 217 days.

(21) Appl. No.: 16/242,565

(22) Filed: Jan. 8, 2019

(65) Prior Publication Data

US 2020/0220247 A1 Jul. 9, 2020

(51) Int. Cl.
*H01Q 1/12* (2006.01)

(52) U.S. Cl.
CPC ..... *H01Q 1/125* (2013.01); *H01Q 1/1207* (2013.01)

(58) Field of Classification Search
CPC ..... H01Q 1/12; H01Q 1/1207; H01Q 1/1228; H01Q 1/125; H01Q 1/18; H01Q 3/02; H01Q 3/04
See application file for complete search history.

(56) References Cited

U.S. PATENT DOCUMENTS 4,126,865 A * 11/1978 Longhurst ..... H01Q 3/08 343/766
4,626,864 A * 12/1986 Micklethwaite ..... H01Q 3/04 248/183.2
5,870,059 A * 2/1999 Reynolds ..... H01Q 1/1242 343/760
10,249,951 B2 * 4/2019 Runyon ..... H01Q 3/08
10,608,316 B2 * 3/2020 Moheb ..... H01Q 15/14
10,637,150 B2 * 4/2020 Tanabe ..... H01Q 3/08

FOREIGN PATENT DOCUMENTS

CA 2486568 A1 * 5/2006 ..... H01Q 1/1228

* cited by examiner

*Primary Examiner* — Dimary S Lopez Cruz
*Assistant Examiner* — Patrick R Holecek
(74) *Attorney, Agent, or Firm* — Withrow & Terranova, P.L.L.C.

(57) ABSTRACT

An adjustable antennal mount has a base bracket, an upper bracket, multiple fasteners, and a leveling instrument. The base bracket has a slanting surface not perpendicular to an assembling axis of base bracket and a rotating axis perpendicular to the slanting surface. The upper bracket is adjustably mounted on the base bracket along the rotating axis and has a diagonal surface and a top surface. The diagonal surface is attached to the slanting surface of the base bracket and is not parallel to the top surface of the upper bracket. The fasteners are connected with the base bracket and the upper bracket and are arranged at spaced intervals. The leveling instrument is mounted in the upper bracket and indicates levelness of the top surface of the upper bracket.

8 Claims, 7 Drawing Sheets

ADJUSTABLE ANTENNA MOUNT

BACKGROUND OF THE INVENTION

1. Field of the Invention

The present invention relates to an antenna mount, and more particularly to an adjustable antenna mount.

2. Description of Related Art

A bottom seat of an antenna has to be placed parallel to a horizontal plane to allow the antenna to receive and transport for satellite signals in good working conditions. However, under environmental restrictions, an antenna mast may not be installed in a way that the bottom seat of the antenna is held parallel to the horizontal plane, thereby negatively affecting the antenna's working functions.

To overcome the shortcomings, the present invention tends to provide an adjustable antenna mount to mitigate or obviate the aforementioned problems.

SUMMARY OF THE INVENTION

The main objective of the invention is to provide an adjustable antenna mount which has a base bracket and an upper bracket attached to each other via an inclined plane. An angle between the top of the upper bracket and the assembling axis of the base bracket can be adjusted by relative rotation between the upper bracket and the base bracket.

The adjustable antenna mount has a base bracket, an upper bracket, multiple fasteners, and a leveling instrument. The base bracket has a bundle clamp having an assembling axis, a first attaching plate fixed on a top of the bundle clamp, and a rotating axis. The first attaching plate has a slanting surface formed on a top of the first attaching plate and being not perpendicular to the assembling axis of the bundle clamp. The rotating axis is perpendicular to the slanting surface of the first attaching plate. The upper bracket is adjustably mounted on the first attaching plate of the base bracket along the rotating axis of the base bracket and has a diagonal surface and a top surface. The diagonal surface is formed on a bottom of the upper bracket and is attached to the slanting surface of the base bracket. The top surface is formed on a top of the upper bracket and is not parallel to the diagonal surface. The fasteners are arranged at spaced intervals and are connected with the base bracket and the upper bracket tightly. The leveling instrument is mounted in the upper bracket and indicates levelness of the top surface of the upper bracket.

Other objects, advantages and novel features of the invention will become more apparent from the following detailed description when taken in conjunction with the accompanying drawings.

DETAILED DESCRIPTION OF PREFERRED EMBODIMENT

Figure 1:
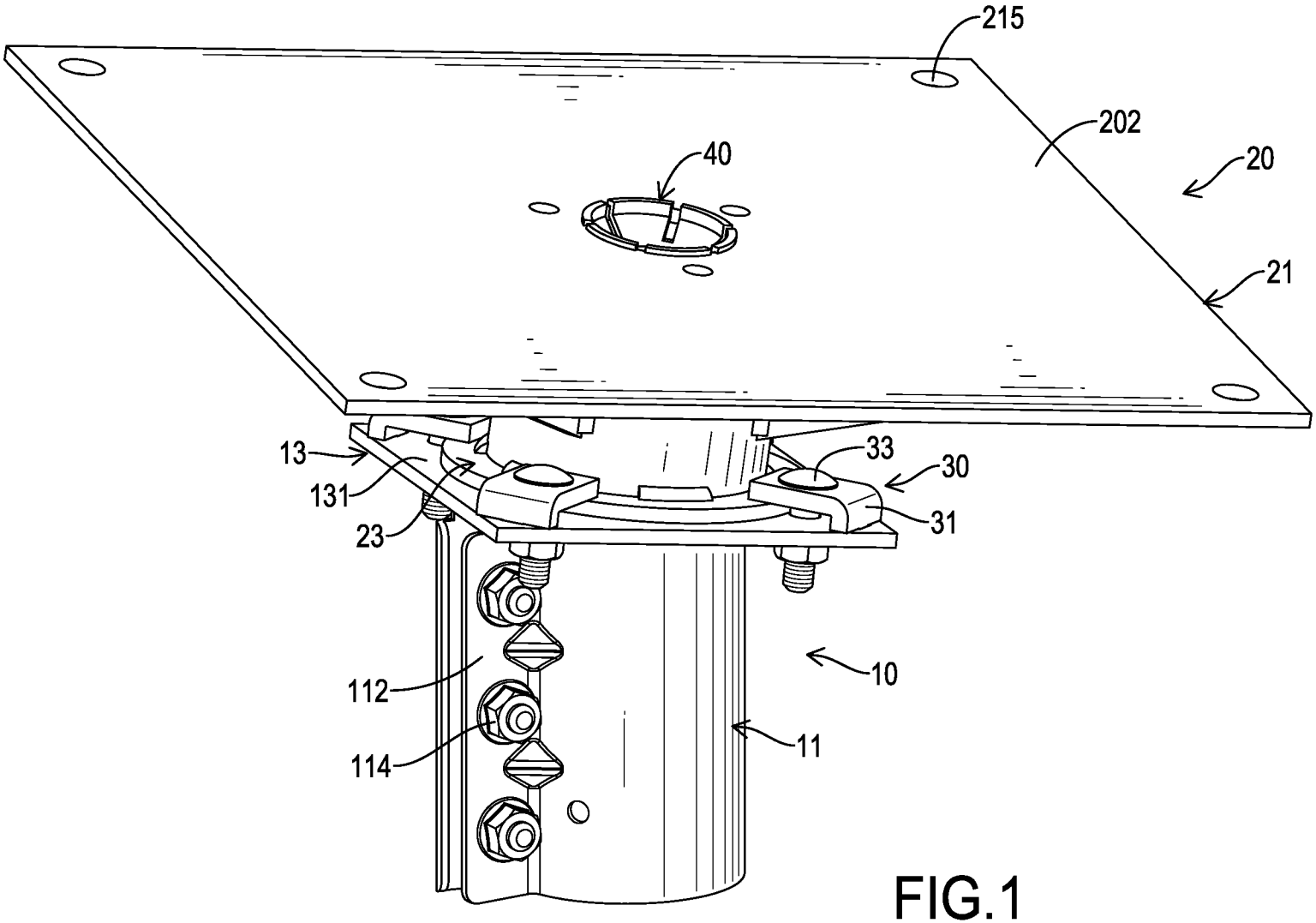
FIG. 1 is a perspective view of an adjustable antenna mount in accordance with the present invention.
Figure 2:
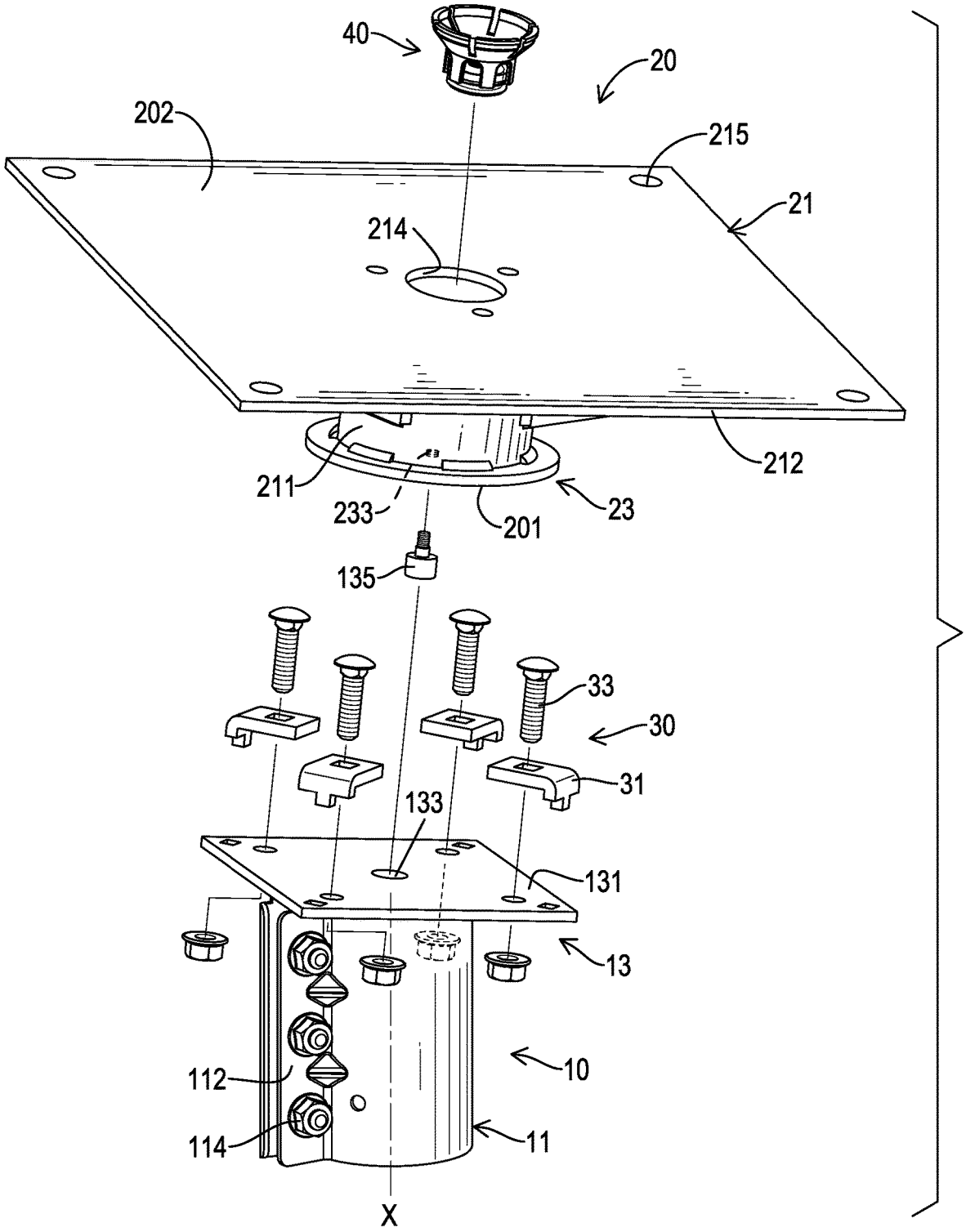
FIG. 2 is an exploded perspective view of the adjustable antenna mount in FIG. 1.
Figure 3:
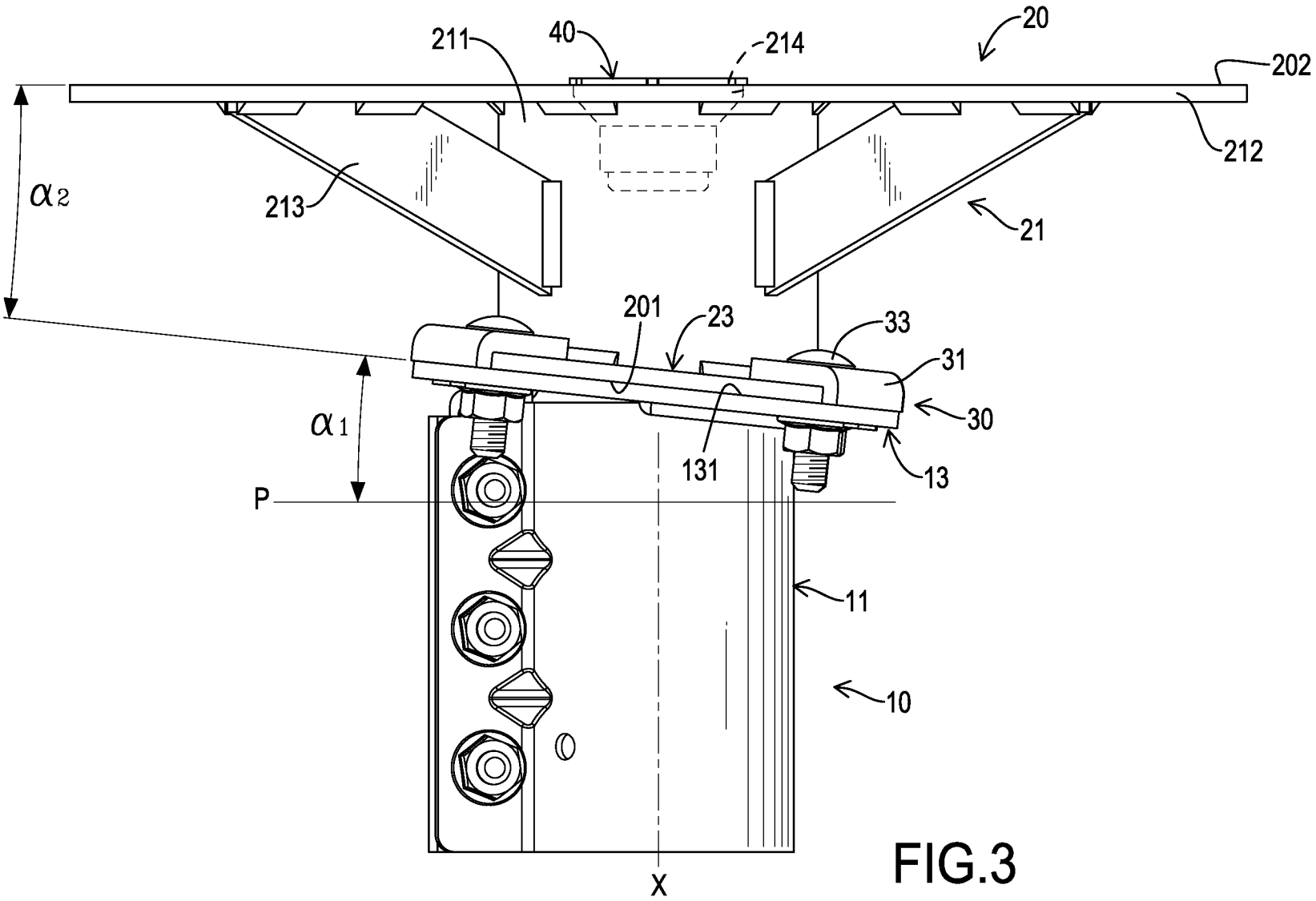
FIG. 3 is a side view of the adjustable antenna mount in FIG. 1.
Figure 4:
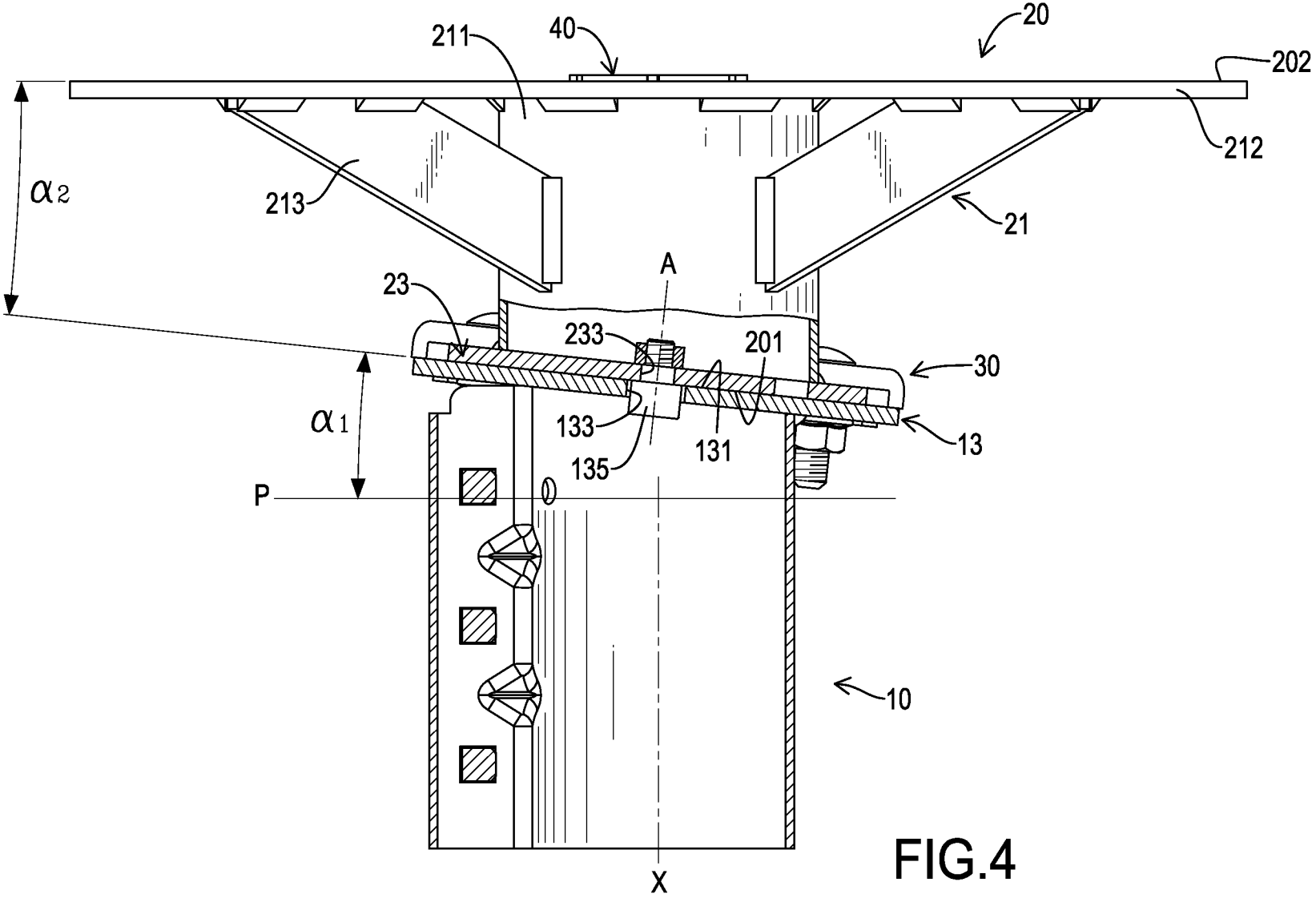
FIG. 4 is a side view in partial section of the adjustable antenna mount in FIG. 1.

With reference to FIGS. 1 to 4, an adjustable antenna mount in accordance with the present invention has a base bracket 10, an upper bracket 20, multiple fasteners 30, and a leveling instrument 40.

The base bracket 10 has a bundle clamp 11, a first attaching plate 13 and a rotating axis A. The bundle clamp 11 is applied for mounting on a mast and has an assembling axis X. The first attaching plate 13 is fixed on the top of the bundle clamp 11 by welding and has a slanting surface 131 formed on the top of the first attaching plate 13. The slanting surface 131 is not perpendicular to the assembling axis X of the bundle clamp 11. A first angle $\alpha 1$ is formed between the slanting surface 131 and a plane P which is perpendicular to the assembling axis X. The rotating axis A is perpendicular to the slanting surface 131 of the first attaching plate 13. Preferably, the bundle clamp 11 has two ears 112 and multiple fastening bolts 114. The cross section of the bundle clamp 11 is C-shaped and has an opening formed in a radial side of the bundle clamp 11. The ears 112 extend respectively from two ends of the opening. The fastening bolts 114 are fastened with the ears 112 for reducing the width of the opening of the bundle clamp 11.

The upper bracket 20 is adjustably mounted on the first attaching plate 13 of the base bracket 10 along the rotating axis A and has a diagonal surface 201, a top surface 202, a stand 21, and a second attaching plate 23. The diagonal surface 201 is formed on the bottom of the upper bracket 20 and is attached to the slanting surface 131 of the first attaching plate 13. The top surface 202 is formed on the top of the upper bracket 20 and is not parallel to the diagonal surface 201. The stand 21 has a body 211 and a top plate 212. The body 211 is a hollow tube. The top plate 212 is fixed on the top of the body 211 by welding. An area of the top plate 212 is larger than an area of the top of the body 211. A top of the top plate 212 is defined as the top surface 202 of the upper bracket 20. The top plate 212 may further have multiple mounting holes 215 for mounting an antenna. The stand 21 may further have multiple support plates 213 connected with the top plate 212 and the body 211 in a radial arrangement to enhance structural strength of the upper bracket 20.

The second attaching plate 23 is fixed on the bottom of the stand 21 by welding. An area of the second attaching plate 23 is larger than an area of the bottom of the stand 21. The bottom of the second attaching plate 23 is defined as the diagonal surface 201, and is attached to the slanting surface 131 of the first attaching plate 13. The second attaching plate 23 and the first attaching plate 13 are rotatably connected with each other along the rotating axis A. The first attaching plate 13 and the second attaching plate 23 each have a respective shaft hole 133, 233. The shaft holes 133, 233 are formed along the rotating axis A, and a shaft 135 is mounted through the shaft holes 133, 233 and is connected with the first attaching plate 13 and the second attaching plate 23. Preferably, a second angle $\alpha 2$ is formed between the diagonal surface 201 of the upper bracket 20 and the top surface 202 of the upper bracket 20, which is equal to the first angle $\alpha 1$. Therefore, the top surface 202 of the upper bracket 20 is perpendicular to the assembling axis X of the bundle clamp 11 in an initial position.

The fasteners 30 are arranged at spaced intervals and are connected with the base bracket 10 and the upper bracket 20 tightly to fix the relative position of the base bracket 10 and the upper bracket 20. Each fastener 30 has a fixing plate 31 and a fastening unit 33. The fixing plate 31 abuts the top of the second attaching plate 23. The fastening unit 33 is connected with the fixing plate 31 and the first attaching plate 13 to provide a fastening force for fastening the first attaching plate 13 and the second attaching plate 23 tightly.

The leveling instrument 40, for example, a bubble level, is mounted in the stand 21 of the upper bracket 20, and indicates levelness of the top surface 202 of the upper bracket 20 being horizontal or not. Preferably, the stand 21 has a cavity 214 recessed in the top surface 202. The leveling instrument 40 is mounted in the cavity 214 and is disposed in the middle of the stand 21. The user can observe the position of the bubble of the leveling instrument 40 from the top.

Figure 5A:
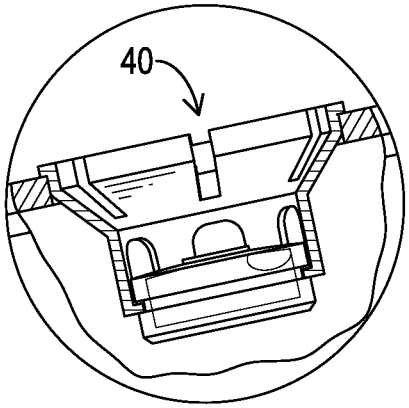
FIG. 5A is an enlarged operational cross sectional side view of the adjustable antenna mount in FIG. 5.
Figure 5:
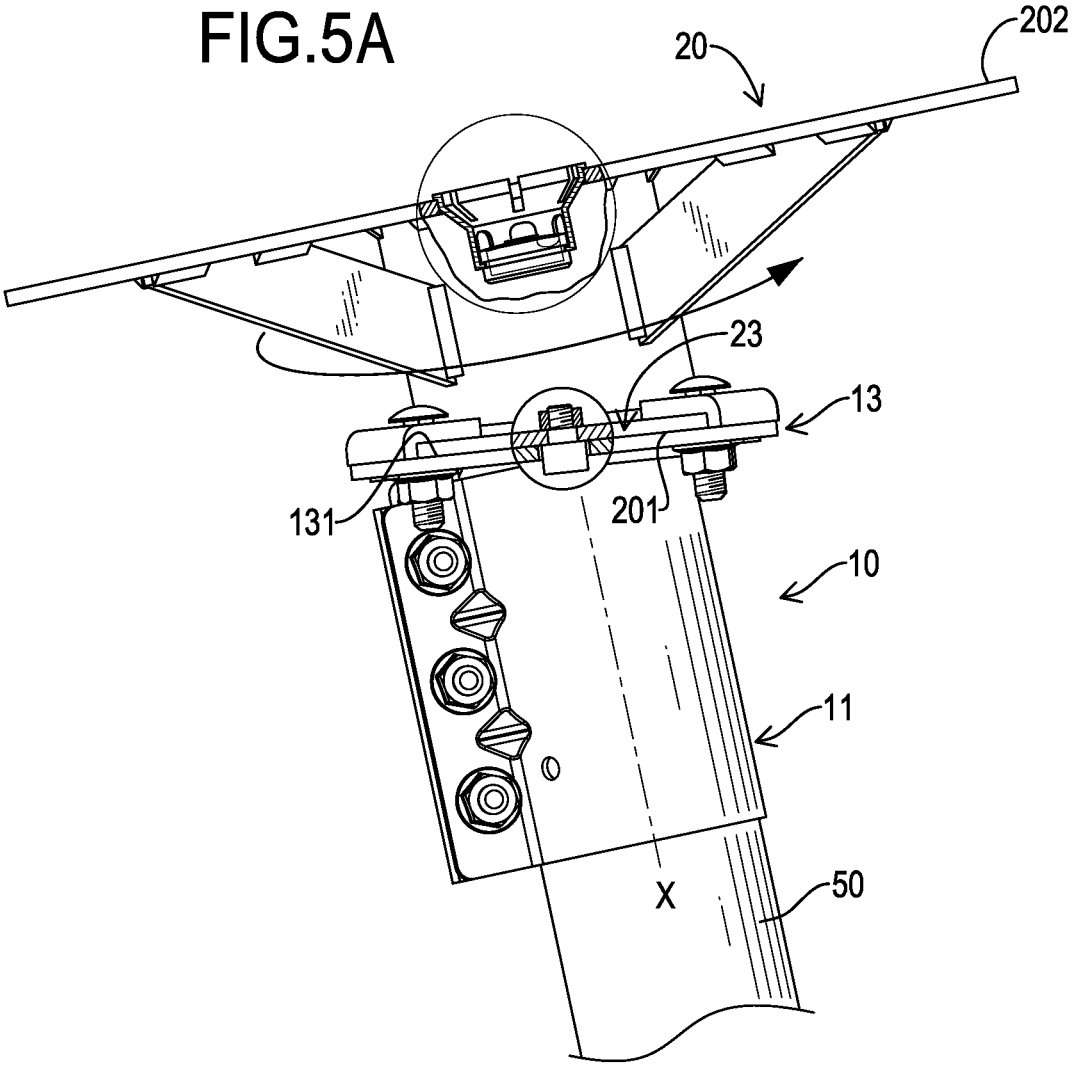
FIG. 5 is an operational side view in partial section of the adjustable antenna mount in FIG. 4, shown assembled on a mast.
Figure 6A:
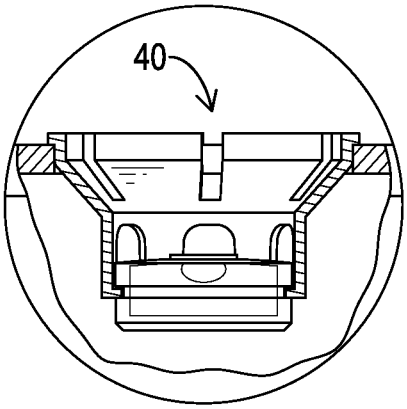
FIG. 6A is an enlarged operational cross sectional side view of the adjustable antenna mount in FIG. 6.
Figure 6:
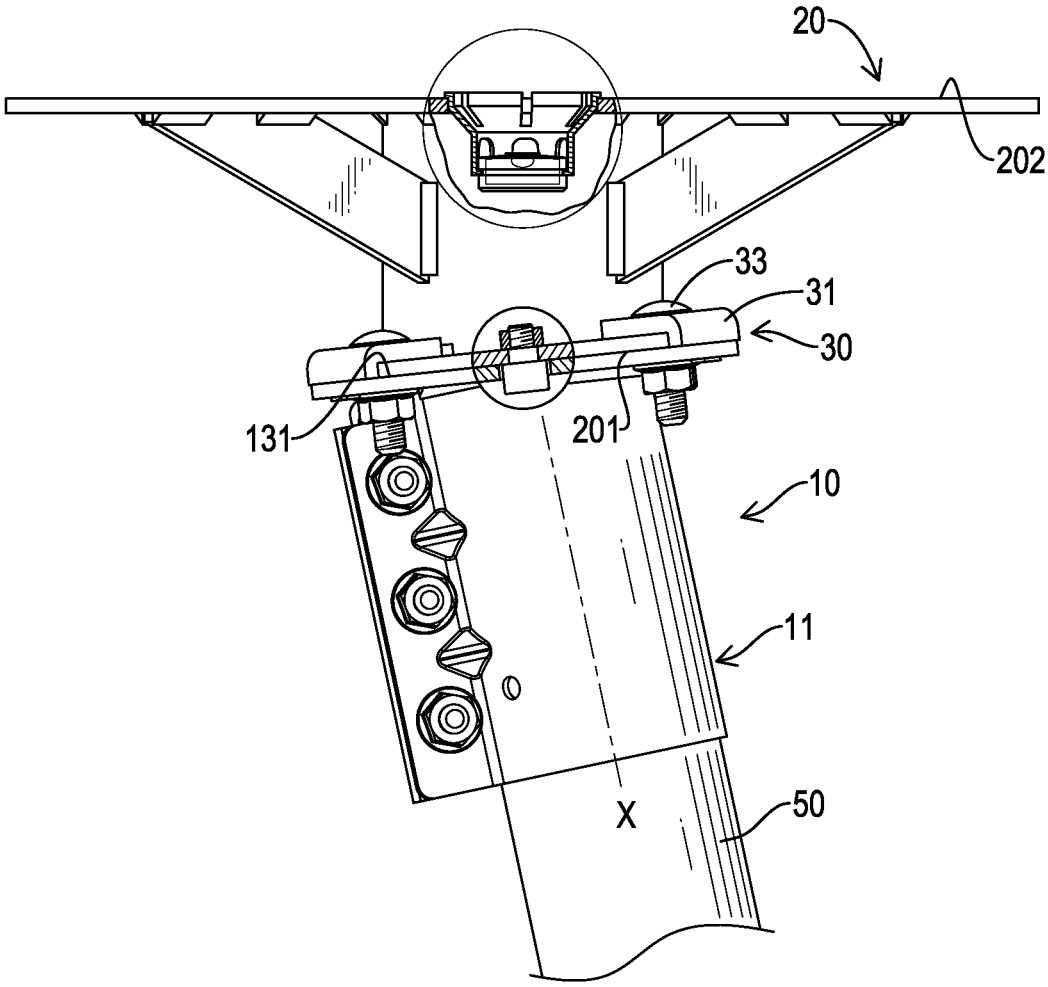
FIG. 6 is an operational side view in partial section of the adjustable antenna mount in FIG. 5, shown assembled on the mast after adjustment.
Figure 7:
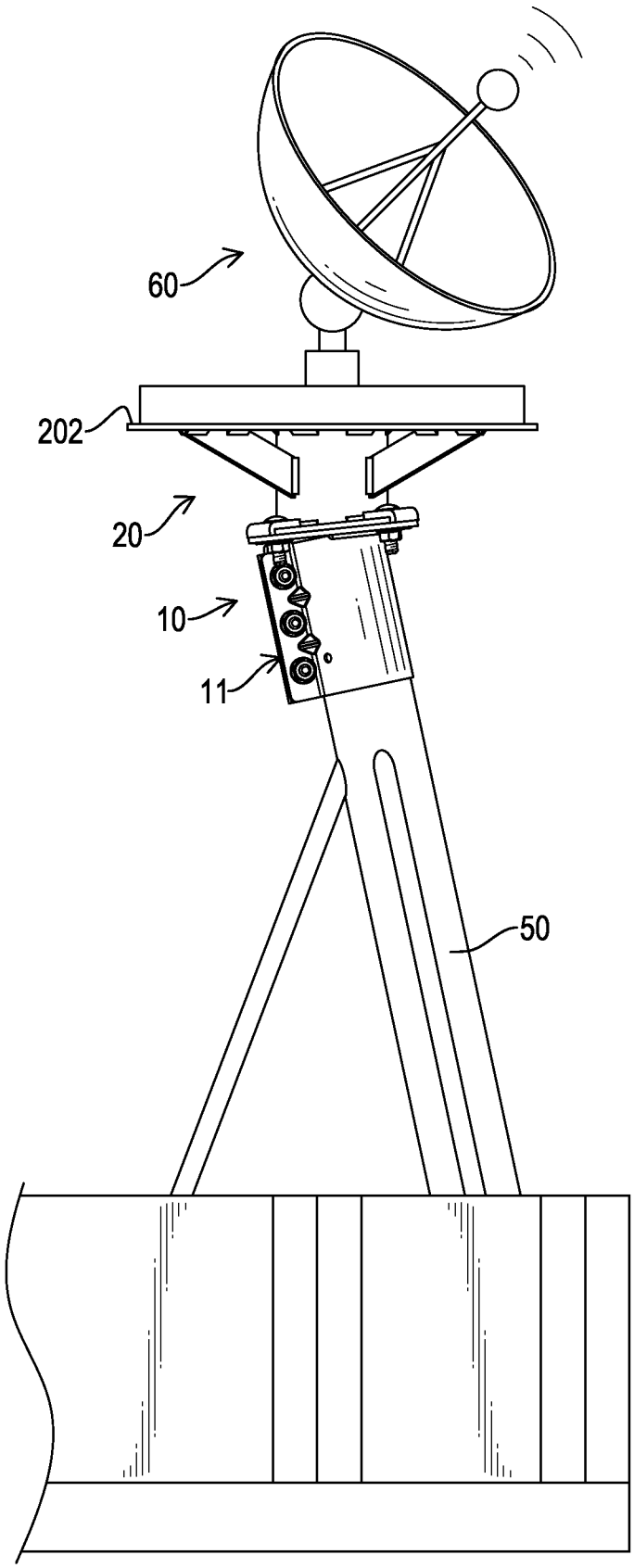
FIG. 7 is an operational side view of the adjustable antenna mount in FIG. 6 showing that an antenna is mounted on the top surface of the upper bracket.

With reference to FIGS. 5 to 7, in a situation that the axial direction of the mast 50 for an antenna is not perpendicular to the horizontal plane, the top surface 202 of the upper bracket 20 will not be parallel to the horizontal plane in the initial position, when the bundle clamp 11 is mounted around the mast 50. Therefore, the bubble of the leveling instrument 40 will be located in the fringe of the leveling instrument 40. The angle between the top surface 202 of the upper bracket 20 and the assembling axis X of the bundle clamp 11 may be adjusted by rotating the upper bracket 20 relative to the base bracket 10. With the attachment of the slanting surface 131 of the base bracket 10 and the diagonal surface 201 of the upper bracket 20, the top surface 202 of the upper bracket 20 will be adjusted to be parallel to the horizontal plane when the bubble of the leveling instrument 40 is located in the center of the leveling instrument 40. After that, the fastening units 33 of the fasteners 30 can be tightened to fasten the fixing plate 31 to fix the relative position of the base bracket 10 and the upper bracket 20. Therefore, the antenna 60 can be mounted on the top surface 202 of the upper bracket 20 which is parallel to the horizontal plane and will work in good conditions with the satellites.

With such an arrangement, the adjustable antenna mount in accordance with the present invention has a simple structure and can be used easily. The angle between the top surface 202 of the upper bracket 20 and the assembling axis X of the bundle clamp 11 can be adjusted by relative rotation between the base bracket 10 and the upper bracket 20. In addition, the leveling instrument 40 can assist the adjustment by indicating the levelness of the top surface 202 of upper bracket 20 being parallel to the horizontal plane or not. So the antenna can be mounted on the top surface 202 of the upper bracket 20, which is parallel to the horizontal plane.

What is claimed is:

1. An adjustable antenna mount comprising:

a base bracket having a bundle clamp having an assembling axis;

a first attaching plate fixed on a top of the bundle clamp and having a slanting surface formed on a top of the first attaching plate and being non-perpendicular to the assembling axis of the bundle clamp; and a rotating axis being perpendicular to the slanting surface of the first attaching plate;

an upper bracket adjustably mounted on the first attaching plate of the base bracket along the rotating axis of the base bracket and having a diagonal surface formed on a bottom of the upper bracket and attached to the slanting surface of the base bracket; and a top surface formed on a top of the upper bracket and being non-parallel to the diagonal surface;

multiple fasteners arranged at spaced intervals and connected with the base bracket and the upper bracket tightly; and a leveling instrument mounted in the upper bracket and indicating levelness of the top surface of the upper bracket, wherein the upper bracket has a stand and a second attaching plate fixed on a bottom of the stand and rotatably connected with the first attaching plate along the rotating axis;

a bottom of the second attaching plate is defined as the diagonal surface of the upper bracket; and a top of the stand is defined as the top surface of the upper bracket;

wherein the first attaching plate and the second attaching plate each have a respective shaft hole formed along the rotating axis; and a shaft is mounted through the shaft holes of the first attaching plate and the second attaching plate;

wherein the upper bracket has a cavity recessed in the top surface of the upper bracket; and the leveling instrument is mounted in the cavity.

2. The adjustable antenna mount as claimed in claim 1, wherein each fastener has a fixing plate abutting a top of the second attaching plate; and a fastening unit connected with the fixing plate and the first attaching plate.

3. The adjustable antenna mount as claimed in claim 2, wherein the stand of the upper bracket has a body; and a top plate fixed on a top of the body and having an area larger than an area of the top of the body.

4. The adjustable antenna mount as claimed in claim 3, wherein the stand of the upper bracket further has multiple support plates connected with the top plate of the stand and the body of the stand in a radial arrangement.

5. The adjustable antenna mount as claimed in claim 1, wherein a first angle formed between the slanting surface of the first attaching plate of the base bracket and a plane perpendicular to the assembling axis of the bundle clamp is equal to a second angle formed between the top surface of the upper bracket and the diagonal surface of the upper bracket.

6. The adjustable antenna mount as claimed in claim 2, wherein a first angle formed between the slanting surface of the first attaching plate of the base bracket and a plane perpendicular to the assembling axis of the bundle clamp is equal to a second angle formed between the top surface of the upper bracket and the diagonal surface of the upper bracket.

7. The adjustable antenna mount as claimed in claim 3, wherein a first angle formed between the slanting surface of the first attaching plate of the base bracket and a plane perpendicular to the assembling axis of the bundle clamp is equal to a second angle formed between the top surface of the upper bracket and the diagonal surface of the upper bracket.

8. The adjustable antenna mount as claimed in claim 4, wherein a first angle formed between the slanting surface of the first attaching plate of the base bracket and a plane perpendicular to the assembling axis of the bundle clamp is equal to a second angle formed between the top surface of the upper bracket and the diagonal surface of the upper bracket.

* * * * *